US011772749B1

(12) United States Patent
Olsen

(10) Patent No.: US 11,772,749 B1
(45) Date of Patent: Oct. 3, 2023

(54) BOAT LAUNCHING DEVICE

(71) Applicant: Michael R. Olsen, East Troy, WI (US)

(72) Inventor: Michael R. Olsen, East Troy, WI (US)

( * ) Notice: Subject to any disclaimer, the term of this patent is extended or adjusted under 35 U.S.C. 154(b) by 393 days.

(21) Appl. No.: 17/235,755

(22) Filed: Apr. 20, 2021

(51) Int. Cl.
*B63B 21/04* (2006.01)
*B63B 21/56* (2006.01)
*B63B 21/20* (2006.01)

(52) U.S. Cl.
CPC ..... *B63B 21/04* (2013.01); *B63B 21/20* (2013.01); *B63B 21/56* (2013.01); *B63B 2021/566* (2013.01)

(58) Field of Classification Search
CPC ... B63B 21/20; B63B 21/56; B23B 2021/203; Y10T 24/314
See application file for complete search history.

(56) References Cited

U.S. PATENT DOCUMENTS 5,066,033 A 11/1991 Kolstad et al.
6,390,009 B2 * 5/2002 Brown ..... B63B 21/00 267/69
2004/0194685 A1 * 10/2004 Slater ..... B63B 21/00 114/230.2
2011/0146558 A1 * 6/2011 Korell ..... B63B 21/54 114/230.26
2017/0274965 A1 * 9/2017 Beck ..... B63B 21/20

FOREIGN PATENT DOCUMENTS

WO WO 2006/105573 10/2006

* cited by examiner

*Primary Examiner* — Robert Sandy
(74) *Attorney, Agent, or Firm* — Donald J. Ersler

(57) ABSTRACT

A boat launching device preferably includes an elastic line, a first elastic line loop and a second elastic line loop. The elastic line includes a first loop end and a second loop end. The first and second loop ends must be capable of being inserted through a rear line tie-off opening. The first elastic line loop is slidably retained on the elastic line with a first clip. The first loop clip is looped around the first elastic line loop and the elastic line. The second elastic line loop is secured to the first loop end with a second clip. The second loop clip is looped through the first loop end and the second elastic line loop. The first loop end is inserted through a rear line tie-off, the first loop clip and a front line tie-off. The second loop end is secured to the front line tie-off.

13 Claims, 6 Drawing Sheets

BOAT LAUNCHING DEVICE

BACKGROUND OF THE INVENTION

1. Field of the Invention

The present invention relates generally to water vessels and more specifically to a boat launching device, which allows a single user to launch a boat.

2. Discussion of the Prior Art

U.S. Pat. No. 5,066,033 to Kolstad et al. discloses a method and apparatus for launching a small boat using rope and retention guide. Patent publication no. WO 2006/105573 to Frier discloses a device for attaching an object to a securing point. U.S. Pat. No. 8,764,343 to Hawkins, Sr. et al. discloses a boat launching device, system and method.

Accordingly, there is a clearly felt need in the art for a boat launching device, which allows a single user to launch a boat adjacent to a pier.

SUMMARY OF THE INVENTION

The present invention provides a boat launching device, which allows a single user to launch a boat. The boat launching device preferably includes an elastic line, a first elastic line loop and a second elastic line loop. The elastic line includes a first loop end and a second loop end. The first and second loop ends must be capable of being either secured to a line tie-off or inserted through a line tie-off opening on a boat. The line tie-off could be a cleat, a rail, or any other suitable projection. The boat tie-off could located anywhere on the boat. The first elastic line loop is retained on the elastic line with a first clip, such that the first elastic line loop slides along a length of the elastic line. The first loop clip is looped around the first elastic line loop and the elastic line. The second elastic line loop is secured to the first loop end with a second clip. The second loop clip is looped through the first loop end and around the second elastic line loop.

The boat is backed into the water on a trailer, adjacent a pier. The first loop end is inserted through a rear line tie-off and secured to a front line tie-off on a boat. The second loop end is secured to the front line tie-off. The second elastic line loop is secured to a first tie-off piling of a pier or a first line tie-off on the pier. The first tie-off piling is located behind a rear of the boat. The first elastic line loop is located between the front and rear line tie-offs. The first elastic line loop is secured to a second tie-off piling of the pier or a second line tie-off of the pier. The second tie-off piling is located between the front and rear line tie-offs on the boat. Once the boat is secured to the pier, the boat is released from the trailer and pushed further into the body of water. The first elastic line loop will be located adjacent the front line tie-off and the second elastic line loop will be located near a rear of the boat. The single user parks their vehicle and trailer. The user walks on to the pier; gets into their boat; and removes the first elastic line loop and the second elastic line loop from the first and second tie-off pilings on the pier. The boat motor may now be powered to propel the boat into the body of water.

Accordingly, it is an object of the present invention to provide a boat launching device, which allows a single user to launch a boat adjacent to a pier.

These and additional objects, advantages, features and benefits of the present invention will become apparent from the following specification.

DETAILED DESCRIPTION OF THE PREFERRED EMBODIMENTS

Figure 2:
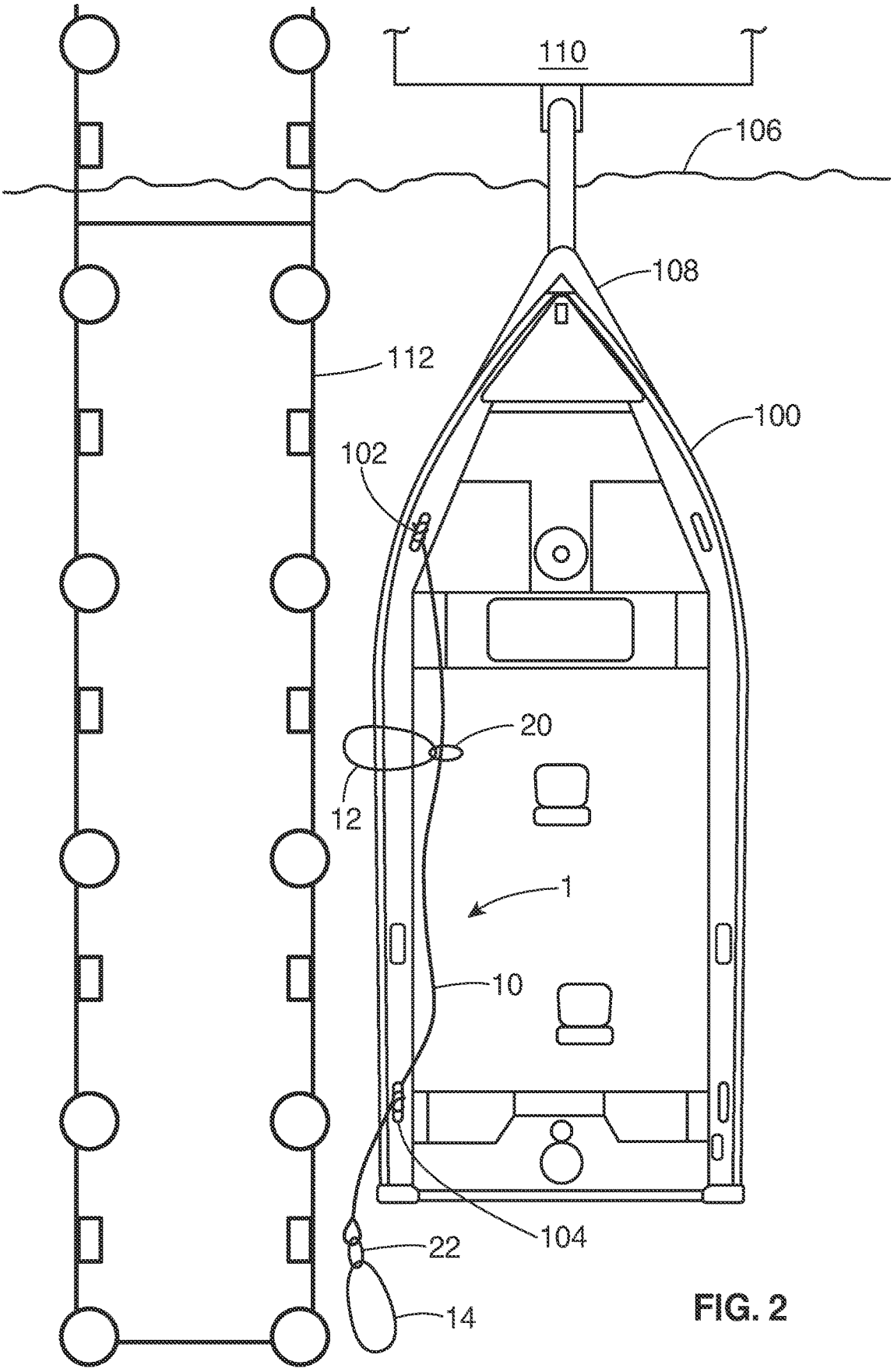
FIG. 2 is a top view of a boat retained on a trailer and inserted into a body of water and after a boat launching device is secured to the boat in accordance with the present invention.
Figure 5:
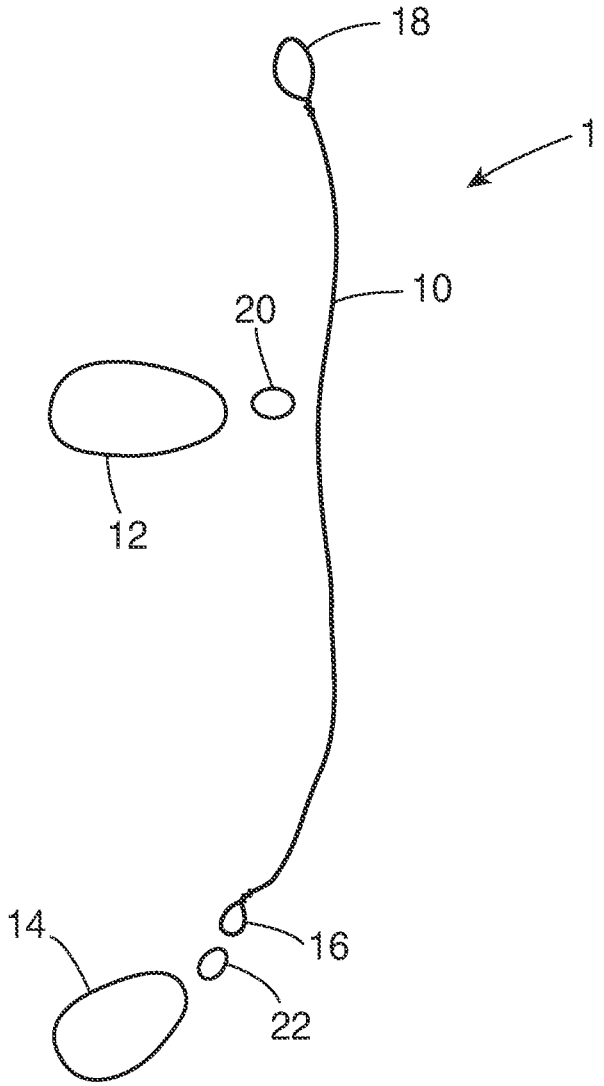
FIG. 5 is a top exploded view of a boat launching device in accordance with the present invention.
Figure 6:
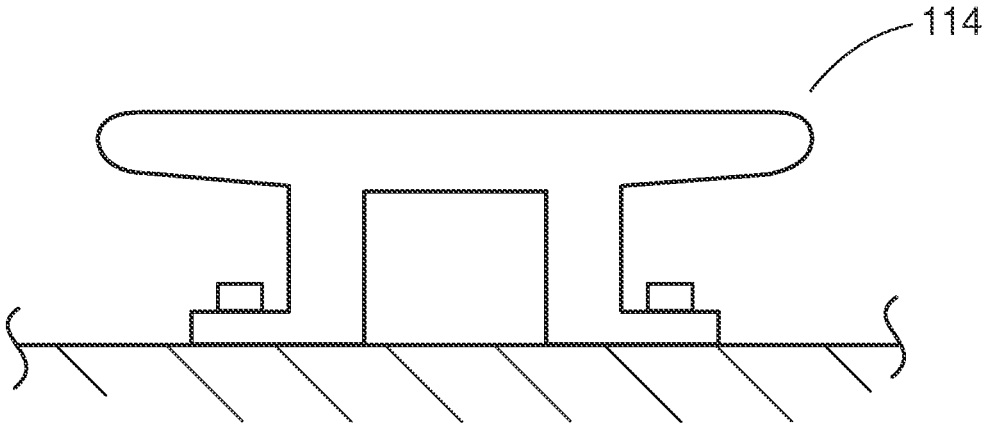
FIG. 6 is a front view of a cleat mounted to a boat.
Figure 7:
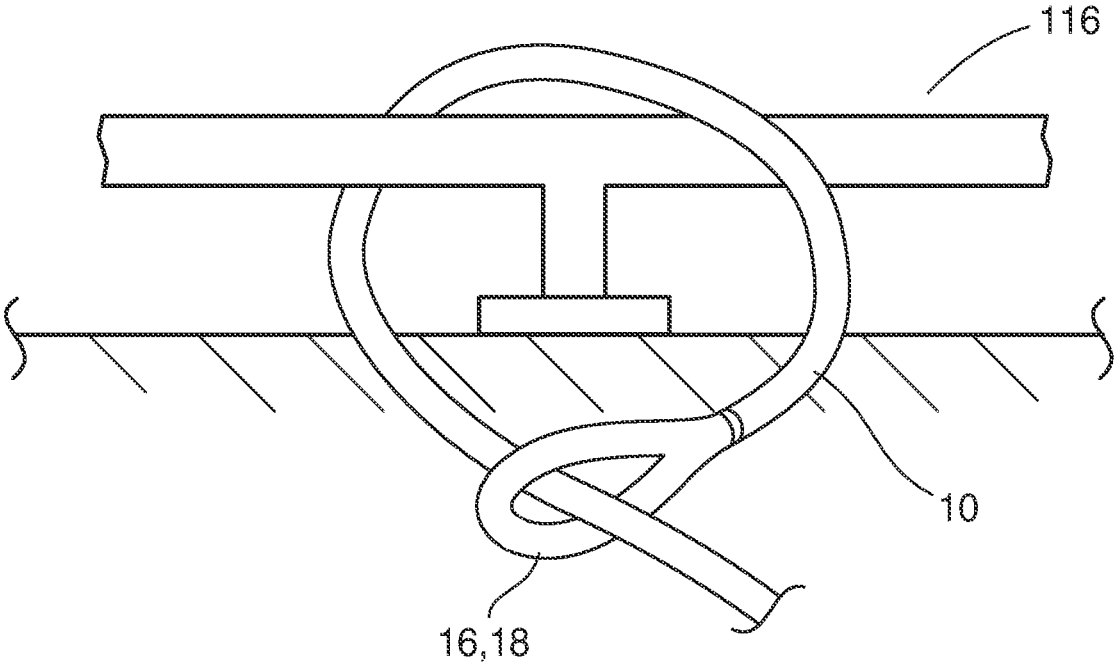
FIG. 7 is a front view of a rail mounted to a boat with an elastic line secured thereto.

With reference now to the drawings, and particularly to FIG. 5, there is shown a top exploded view of a boat launching device 1. The boat launching device 1 preferably includes an elastic line 10, a first elastic line loop 12 and a second elastic line loop 14. The elastic line 10 includes a first loop end 16 formed on one end and a second loop end 18 formed on an opposing end. With reference to FIG. 2, the first and second loop ends 16, 18 must be capable of being either secured to a front line tie-off 102 or inserted through an opening in a rear line tie-off 104 on a boat 100. With reference to FIGS. 6-7, the line tie-off could be a cleat 114, a rail 116, or any other suitable projection. The line tie-off could also be called retention projection. The elastic line 10, the first elastic line loop 12, the second elastic line loop 14, the first loop end 16 and the second loop end 18 all have an elastic or stretchable length. After the length is stretched, the length goes back to its original length, before stretching. The first elastic line loop 12 is retained on the elastic line 10 with a first loop clip 20, such that the first elastic line loop 12 slides along a length of the elastic line 10. The first loop clip 20 is looped through the first elastic line loop 12 and around the elastic line 10. The second elastic line loop 14 is secured to the first loop end 16 with a second loop clip 22. The second loop clip 22 is looped through the first loop end 16 and around the second elastic line loop 14.

The first and second loop clips 20, 22 may be solid loop clips, or spring loaded clips, such as a carabiner, or any other suitable loop clips. The solid loop clips would be split and spread to allow insertion through the first or second elastic line loops 12, 14; and the first loop end 16. The spread is closed to prevent escape of the elastic line 10, the first elastic line loop 12, the second elastic line loop 14 or the first loop end 16. The first and second loop clips 20, 22 are preferably fabricated from a metal material, but other materials may also be used. If the first and second loop clips 20, 22 are solid clips, the boat launching device 1 may come assembled with the first clip looped through the first elastic loop 12, and the first loop end 16 secured to the second elastic loop 14 with the second loop clip 22. The second loop end 18 would be inserted through the first loop clip 20 to complete the assembly of the boat launching device 1.

Figure 1:
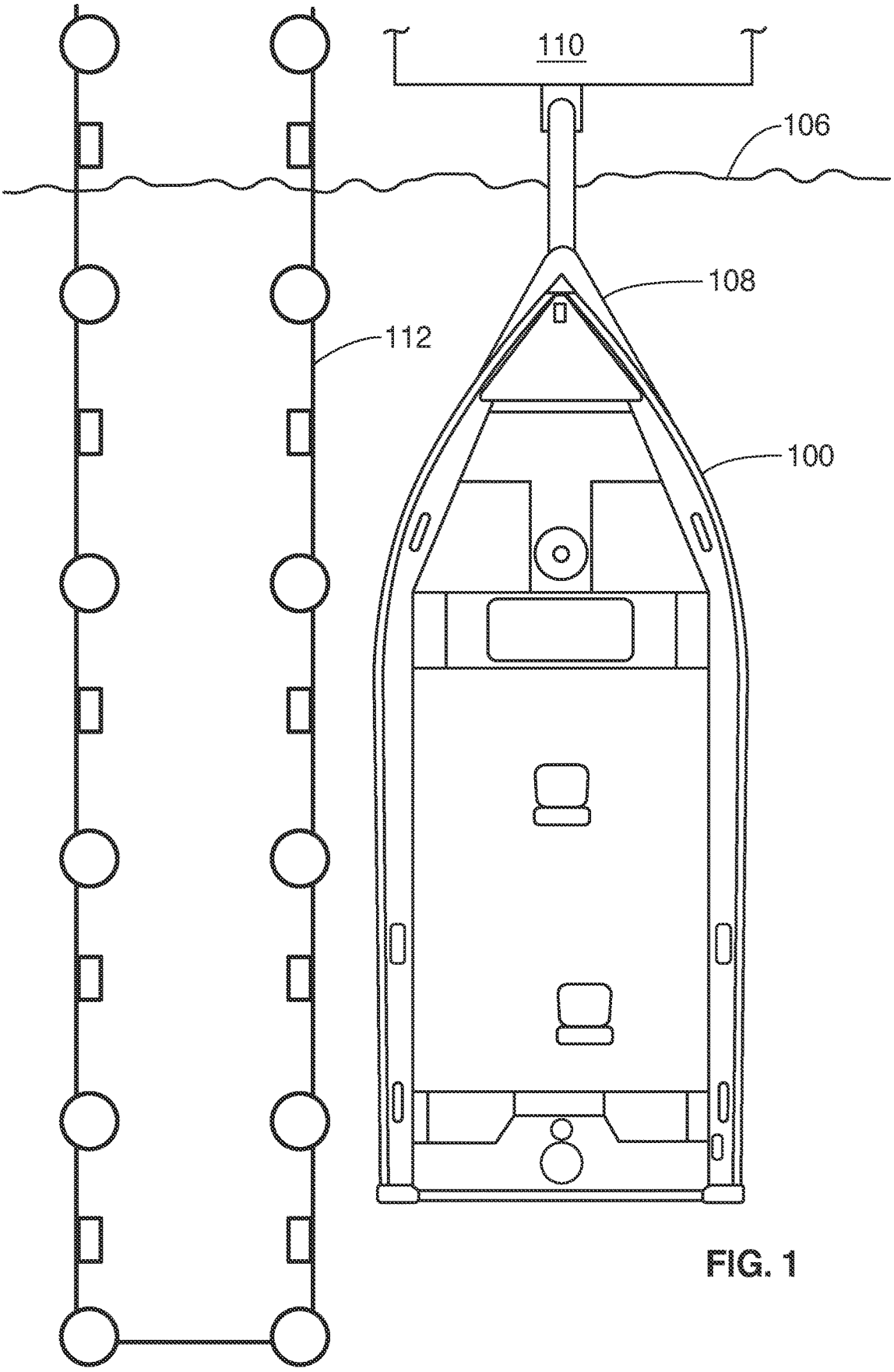
FIG. 1 is a top view of a boat retained on a trailer and inserted into a body of water, adjacent a pier.
Figure 3:
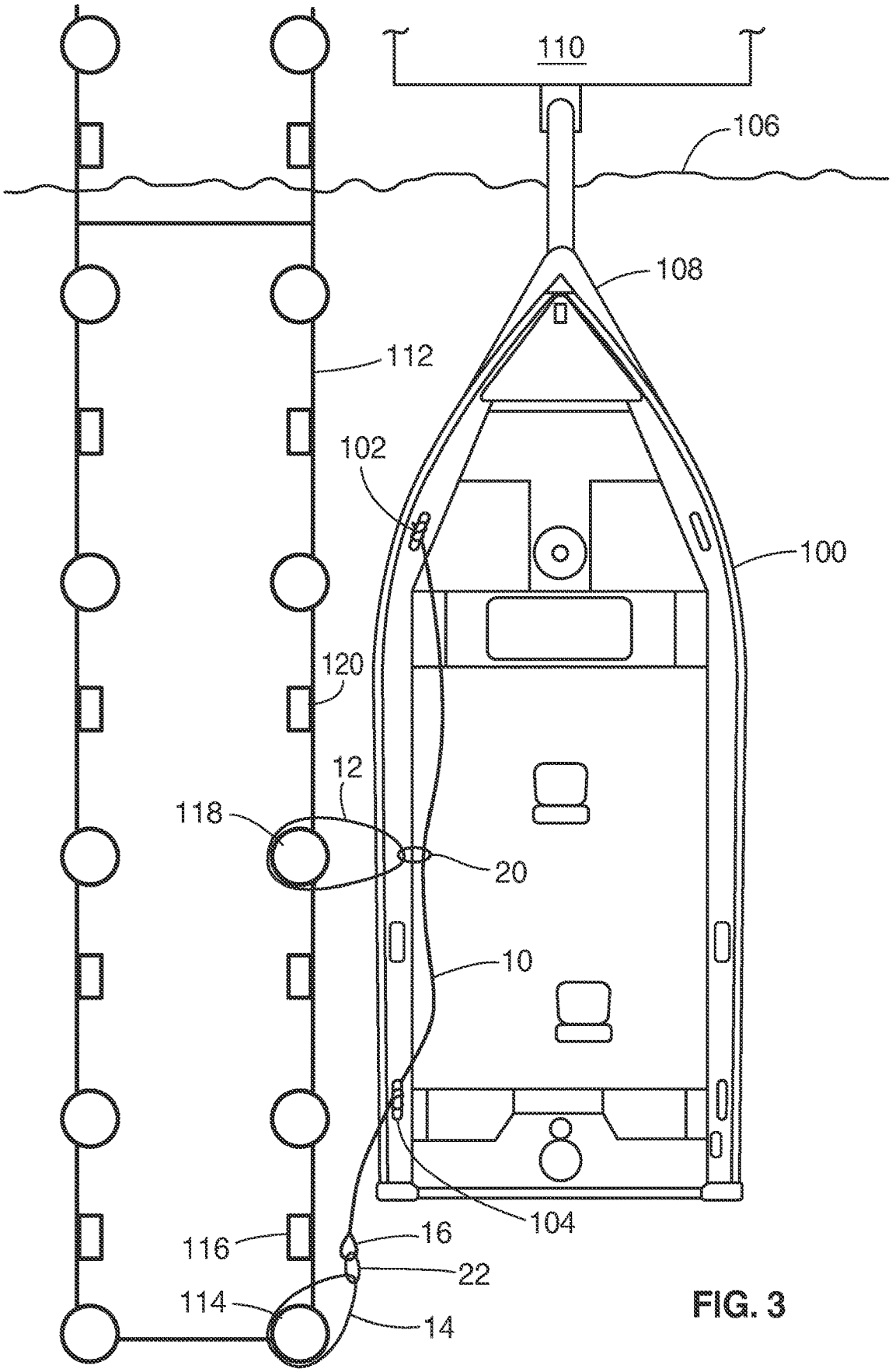
FIG. 3 is a top view of a boat retained on a trailer and inserted into a body of water and after a boat launching device is secured to the boat and a pier in accordance with the present invention.

With reference to FIGS. 1 and 3, the boat 100 is backed into a body of water 106 on a trailer 108 with a vehicle 110, adjacent a pier 112. The first loop end 16 is inserted through an opening in the rear line tie-off 104 and the second loop end is secured to the front line tie-off 102. The second elastic line loop 14 is secured to a first tie-off piling 114 of a pier 112 or a first line tie-off 116 of the pier 112. The first tie-off piling 114 is located behind a rear of the boat 100. The first elastic line loop 12 is located between the front and rear line tie-offs 102, 104. The first elastic line loop 12 is secured to a second tie-off piling 118 of the pier 112 or a second line tie-off 120 of the pier 112. The second tie-off piling 118 is located between the front and rear line boat tie-offs 102, 104.

Figure 4:
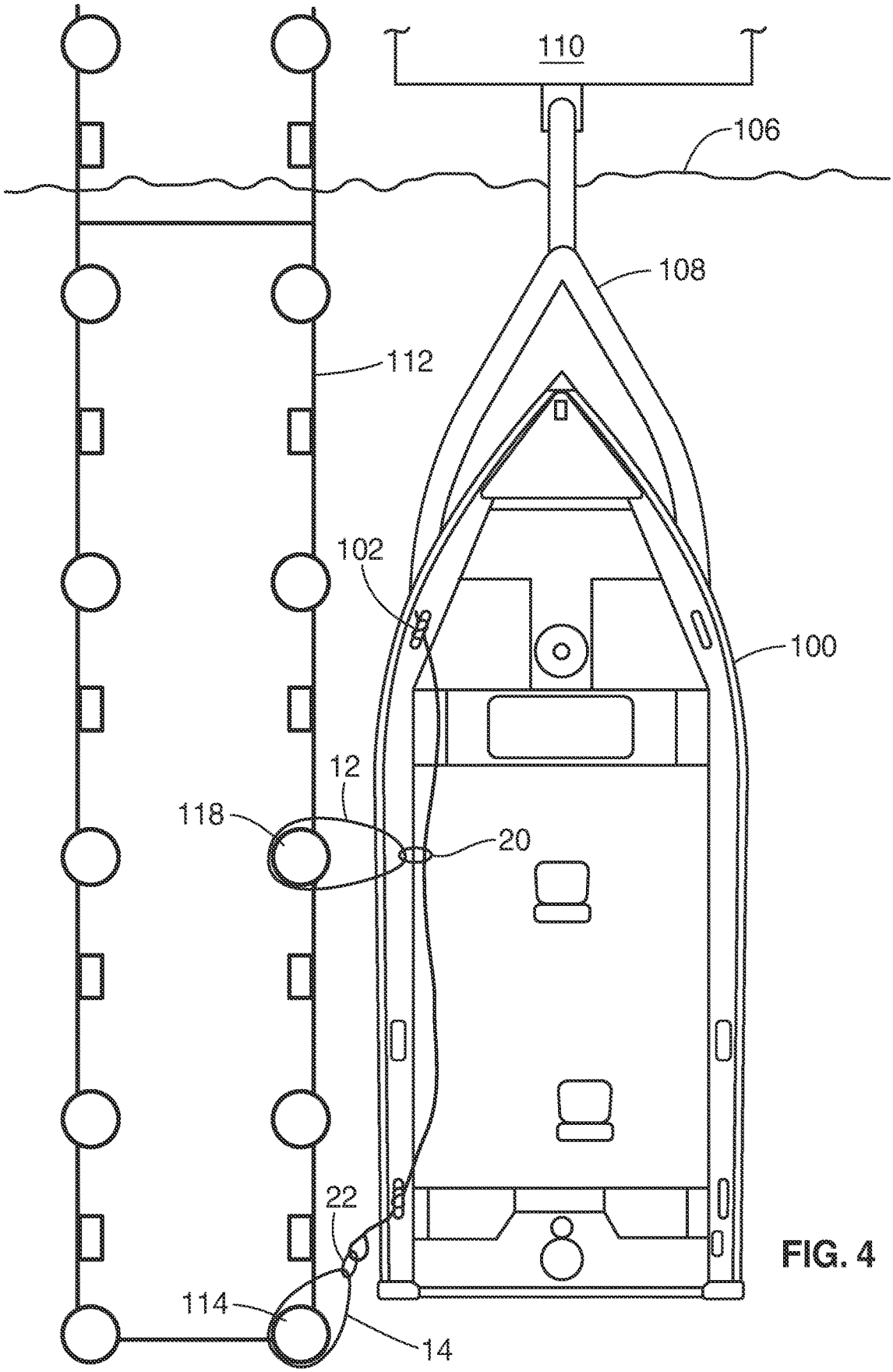
FIG. 4 is a top view of a boat inserted into a body of water; released from a trailer; and pushed further into a body of water with a boat launching device secured to the boat and a pier in accordance with the present invention.

With reference to FIG. 4, once the boat 100 is secured to the pier 112, the boat 100 is released from the trailer 108 and pushed further into the body of water 106. The first elastic line loop 12 will be located adjacent the front boat line tie-off 102 and the second elastic line loop 14 will be located near a rear of the boat 100. The single user parks their vehicle and trailer. The user walks on to the pier 112; gets into their boat 100; and releases the first elastic line loop 12 and the second elastic line loop 14 from the first and second tie-off pilings 116, 118 on the pier 112. A boat motor may now be powered to propel the boat 100 further into the body of water 106.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A boat launching device comprising:

an elastic line includes a first loop end disposed on one end;

a first loop clip;

a first elastic line loop is slidably retained relative to said elastic line by looping said first loop clip around said elastic line and said first elastic line loop;

a second loop clip; and a second elastic line loop is retained relative to said first loop end with said second loop clip.

2. The boat launching device of claim 1 wherein:

said elastic line, said first loop end, said first elastic line loop and said second elastic line loop include stretchable lengths.

3. The boat launching device of claim 1 wherein:

said first loop clip and said second loop clip are solid loops.

4. The boat launching device of claim 1 wherein:

said first loop clip and said second loop clip are carabiners or spring loaded clips.

5. A boat launching device comprising:

an elastic line includes a first loop end disposed on one end and a second loop end disposed on an opposing end;

a first loop clip;

a first elastic line loop is slidably retained relative to said elastic line by looping said first loop clip around said elastic line and through said first elastic line loop;

a second loop clip; and a second elastic line loop is retained relative to said first loop end with said second loop clip.

6. The boat launching device of claim 5 wherein:

said elastic line, said first loop end, said second loop end, said first elastic line loop and said second elastic line loop include stretchable lengths.

7. The boat launching device of claim 5 wherein:

said first loop clip and said second loop clip are solid loops.

8. The boat launching device of claim 5 wherein:

said first loop clip and said second loop clip are carabiners or spring loaded clips.

9. A boat launching device for a boat having a front retention projection and a rear retention projection, comprising:

an elastic line includes a first loop end disposed on one end and a second loop end disposed on an opposing end;

a first loop clip;

a first elastic line loop is slidably retained relative to said elastic line by looping said first loop clip around said elastic line and through said first elastic line loop;

a second loop clip; and a second elastic line loop is retained relative to said first loop end with said second loop clip, wherein said second loop end is inserted through an opening in the rear retention projection, said second loop end is secured to the front retention projection.

10. The boat launching device of claim 9 wherein:

said elastic line, said first loop end, said second loop end, said first elastic line loop and said second elastic line loop include stretchable lengths.

11. The boat launching device of claim 9 wherein:

said first loop clip and said second loop clip are solid loops.

12. The boat launching device of claim 9 wherein:

said first loop clip and said second loop clip are carabiners or spring loaded clips.

13. The boat launching device of claim 9 wherein:

the front retention projection is one of a cleat and a rail and the rear retention projection is one of a second cleat or a second rail.

* * * * *